US012543847B1

(12) United States Patent
Taylor

(10) Patent No.: US 12,543,847 B1
(45) Date of Patent: Feb. 10, 2026

(54) SELF-SUPPORTING AND CONCEALING TOOTHBRUSH

(71) Applicant: David Lee Taylor, Belmont, CA (US)

(72) Inventor: David Lee Taylor, Belmont, CA (US)

( * ) Notice: Subject to any disclaimer, the term of this patent is extended or adjusted under 35 U.S.C. 154(b) by 302 days.

(21) Appl. No.: 16/998,818

(22) Filed: Aug. 20, 2020

(51) Int. Cl.
*A46B 15/00* (2006.01)
*A46B 9/04* (2006.01)

(52) U.S. Cl.
CPC ..... *A46B 15/0095* (2013.01); *A46B 9/04* (2013.01); *A46B 15/0097* (2013.01); *A46B 2200/1066* (2013.01)

(58) Field of Classification Search
CPC . A46B 15/0095; A46B 15/0097; A46B 17/04; A46B 9/04; A46B 2200/1066
USPC ..... 206/362.2–362.3, 15.2–15.3; 15/247
See application file for complete search history.

(56) References Cited

U.S. PATENT DOCUMENTS 543,028 A * 7/1895 Laws ..... A46B 9/04 132/308
2,241,584 A * 5/1941 Cohen ..... A46B 9/04 359/882
4,274,174 A * 6/1981 Ertel ..... A46B 5/02 15/167.1
4,558,483 A * 12/1985 Noser ..... A46B 5/025 15/167.1
5,860,190 A * 1/1999 Cano ..... A47G 21/02 16/DIG. 12
5,956,796 A * 9/1999 Lodato ..... A46B 5/02 248/910
D492,116 S * 6/2004 Nanda ..... D4/101
7,007,335 B1 * 3/2006 Doat ..... A46B 15/0097 248/910
7,246,400 B2 * 7/2007 Ryan ..... A46B 17/04 132/308
7,904,988 B2 * 3/2011 Stein ..... A46B 17/02 248/688
2011/0089307 A1 * 4/2011 Brooks ..... A46B 15/0085 248/176.3

FOREIGN PATENT DOCUMENTS

CH 180027 A * 10/1935 ..... A46B 15/0097
GB 189606674 A * 1/1897 ..... A46B 15/00
JP 2015-126819 A * 7/2015 ..... A46B 15/00
KR 100783021 B1 * 12/2007 ..... A46B 17/04
KR 10-2010-013227 * 9/2010 ..... A46B 15/0097
KR 101861186 B1 * 5/2018 ..... A46B 15/0095
WO WO 90/12522 * 11/1990 ..... A46B 17/04
WO WO 91/07114 A1 * 5/1991 ..... A46B 5/02

* cited by examiner

*Primary Examiner* — Laura C Guidotti
(74) *Attorney, Agent, or Firm* — Haverstock & Owens

(57) ABSTRACT

A self-protecting toothbrush comprises a self-protecting structure is disclosed. The self-protecting structure can contain an automatically expending stand. The self-protecting structure is also can contain an automatically concealing case. When in use, the self-protecting structure automatically decoupled from a body of the toothbrush, so that the self-protecting structure does not hinder the use of the toothbrush. When in a rest position, the self-protecting structure automatically covers or elevates the head or bristles preventing the bristles from touching a surface.

6 Claims, 6 Drawing Sheets

SELF-SUPPORTING AND CONCEALING TOOTHBRUSH

FIELD OF THE INVENTION

The present invention related to the field of toothbrush. More specifically, the present invention related to a self-supporting and concealing toothbrush.

BACKGROUND OF THE INVENTION

Toothbrush is an oral hygiene tool that is used to clean the teeth, gums, and tongue. Since its invention, the structure has been generally accepted and has not changed a lot, which typically contains head of tightly clustered bristles, atop of which toothpaste can be applied, mounted on a handle which helps the cleaning of hard-to-reach areas of the mouth. One of the major drawbacks of the typical toothbrushes include that the head and clustered bristles are exposed and may be in direct contact of the surface when the toothbrush is placed on a surface.

SUMMARY OF THE INVENTION

A toothbrush with a protective structure that prevents the head and bristles from touching a surface when the toothbrush is not in use. In an aspect, a toothbrush contains a self-supporting structure for preventing the toothbrush head from touching a surface. In another aspect, a toothbrush with a self-concealing structure is used to prevent the pollution on the head of the toothbrush.

In an aspect, a self-supporting toothbrush comprises a handle on a first end of a body, bristles on a second end of the body, and a self-supporting structure on the body. In some embodiments, the self-supporting structure comprises a stand. In other embodiments, the stand structurally elevates the bristles when the toothbrush is placed on a surface. In some other embodiments, the stand structurally elevates the bristles when the toothbrush is placed on a surface. In some embodiments, the stand comprises a C-ring structure. In other embodiments, the stand comprises a closed loop structure. In some other embodiments, the closed loop structure comprise a C-ring and a bar structure forming a closed loop.

In some embodiments, the bar structure is rotatable in a through hole of the body. In other embodiments, the self-supporting structure is folded towards the body when the toothbrush is pointing against the ground. In some other embodiments, the self-supporting structure is pivotally rotating around an axis on the body.

In another aspect, a self-concealing toothbrush comprises a handle on a first end of a body, bristles on a second end of the body, and a self-concealing structure on the body. In some embodiments, the self-concealing structure comprises a cover. In other embodiments, the cover is structured to enclose the entire bristles when the body rests against a surface. In some other embodiments, the cover is structured to automatically decouple from the bristles when the self-concealing toothbrush is removed from a resting surface.

In another aspect, a method of making a self-protecting toothbrush comprises forming a body, coupling bristles on the body, and coupling a self-protecting structure with the body. In some embodiments, the self-protecting structure comprises a self-extending stand. In other embodiments, the method further comprises making the self-extending stand pivotally rotating along an axis on the body. In some other embodiments, the self-protecting structure comprises a self-concealing case. In some embodiments, the method further comprises making the self-concealing case automatically covering the bristles when the self-protecting toothbrush is in a resting position. In some other embodiments, the method further comprises making the self-concealing case automatically decoupled with the bristles when the self-protecting toothbrush is in a utilizing position.

In another aspect, an angled toothbrush comprises a handle on a first end of a body and a head portion with bristles on a second end of the body, wherein the head portion extending out at a predetermined angle from the handle. In some embodiments, the handle has a weight sufficient to keep the head in the air at a resting position. In other embodiments, the handle has a substantially flat body in contact with a resting surface preventing a side turning of the substantially flat body. In some other embodiments, the predetermined angle is between 20-60 degrees.

In another aspect, a self-supporting toothbrush having a cylindrical body comprising a handle on a first end of a body, wherein the first end of a body has a cylindrical shape and a head portion with bristles on a second end of the body, wherein the head portion extends out from a center of the first end of the body, wherein the first end of a body has a diameter great than the height of the head portion with a height of the bristles.

In some embodiments, the diameter of the first end of the body prevents the head portion and the bristles from touching a surface. In other embodiments, the cylindrical body allows the toothbrush to freely rolling on a surface.

Other features and advantages of the present invention will become apparent after reviewing the detailed description of the embodiments set forth below.

BRIEF DESCRIPTION OF THE DRAWINGS

Embodiments will now be described by way of examples, with reference to the accompanying drawings which are meant to be exemplary and not limiting. For all figures mentioned herein, like numbered elements refer to like elements throughout.

DETAILED DESCRIPTION OF THE PREFERRED EMBODIMENT

Reference is made in detail to the embodiments of the present invention, examples of which are illustrated in the accompanying drawings. While the invention is described in conjunction with the embodiments below, it is understood that they are not intended to limit the invention to these embodiments and examples. On the contrary, the invention is intended to cover alternatives, modifications and equivalents, which can be included within the spirit and scope of the invention as defined by the appended claims. Furthermore, in the following detailed description of the present invention, numerous specific details are set forth in order to more fully illustrate the present invention. However, it is apparent to one of ordinary skill in the prior art having the benefit of this disclosure that the present invention can be practiced without these specific details. In other instances, well-known methods and procedures, components and processes have not been described in detail so as not to unnecessarily obscure aspects of the present invention. It is, of course, appreciated that in the development of any such actual implementation, numerous implementation-specific decisions must be made in order to achieve the developer's specific goals, such as compliance with application and business related constraints, and that these specific goals vary from one implementation to another and from one developer to another. Moreover, it is appreciated that such a development effort can be complex and time-consuming, but is nevertheless a routine undertaking of engineering for those of ordinary skill in the art having the benefit of this disclosure.

Figure 1:
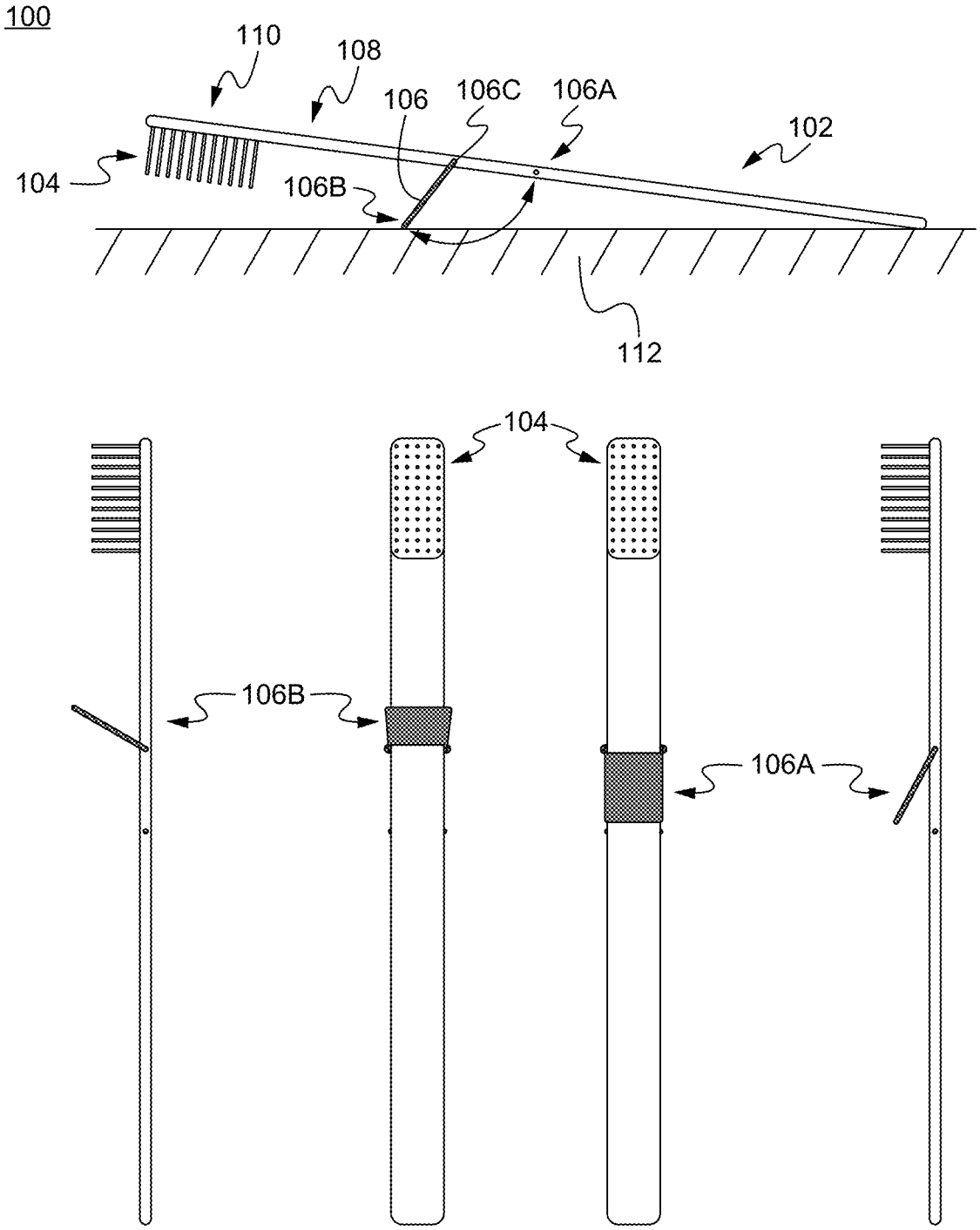
FIG. 1 illustrates a self-supporting toothbrush in accordance with some embodiments.

FIG. 1 illustrates a self-supporting toothbrush 100 in accordance with some embodiments. The toothbrush 100 comprises a body 102. At one terminal end, the body 102 has a head 110 having clustered bristles 104 couple with the head 110. The body 102 comprises a supporting structure 106, which provides a self-supporting force preventing the head 110 and/or the clustered bristles 104 from touching a surface 112. The surface 112 can be any surface for resting and for placing the toothbrush 100 when not in use.

In some embodiments, the supporting structure 106 is configured to be in a closed position 106A when the toothbrush 102 is in use (e.g., in an upright or standing up position) or not in a rest position. In the close position 106A, the supporting structure 106 is folded inward toward the body 102 of the toothbrush 100. When the toothbrush 100 is in a resting position, the supporting structure 106 (e.g., a kick stand) is in an open position 106B. In the open position 106B, the supporting structure 106 serves as a stand elevating the head 110 of the toothbrush, which prevents the head 110 from touching the surface 112.

In an example, a user is taking the toothbrush 100 to brush his/her teeth. The toothbrush 100 is lifted from the surface 112, so that the supporting structure 106 is transiting from an open position 106B to a close position 106A. Due to gravity, the supporting structure 106 folds inwards toward the body 102 automatically when the toothbrush 100 is lifted up from a rest position to an upright position. In some embodiments, the supporting structure 106 is loosely and freely rotating along the rotational axis 106C, so that the supporting structure 106 is freely transitioning proportionally between the open position 106B and the close position 106A. In some embodiments, the supporting structure 106 can be clipped on the sides of a body 108 and slid along the body 108 of the toothbrush 100.

Figure 2:
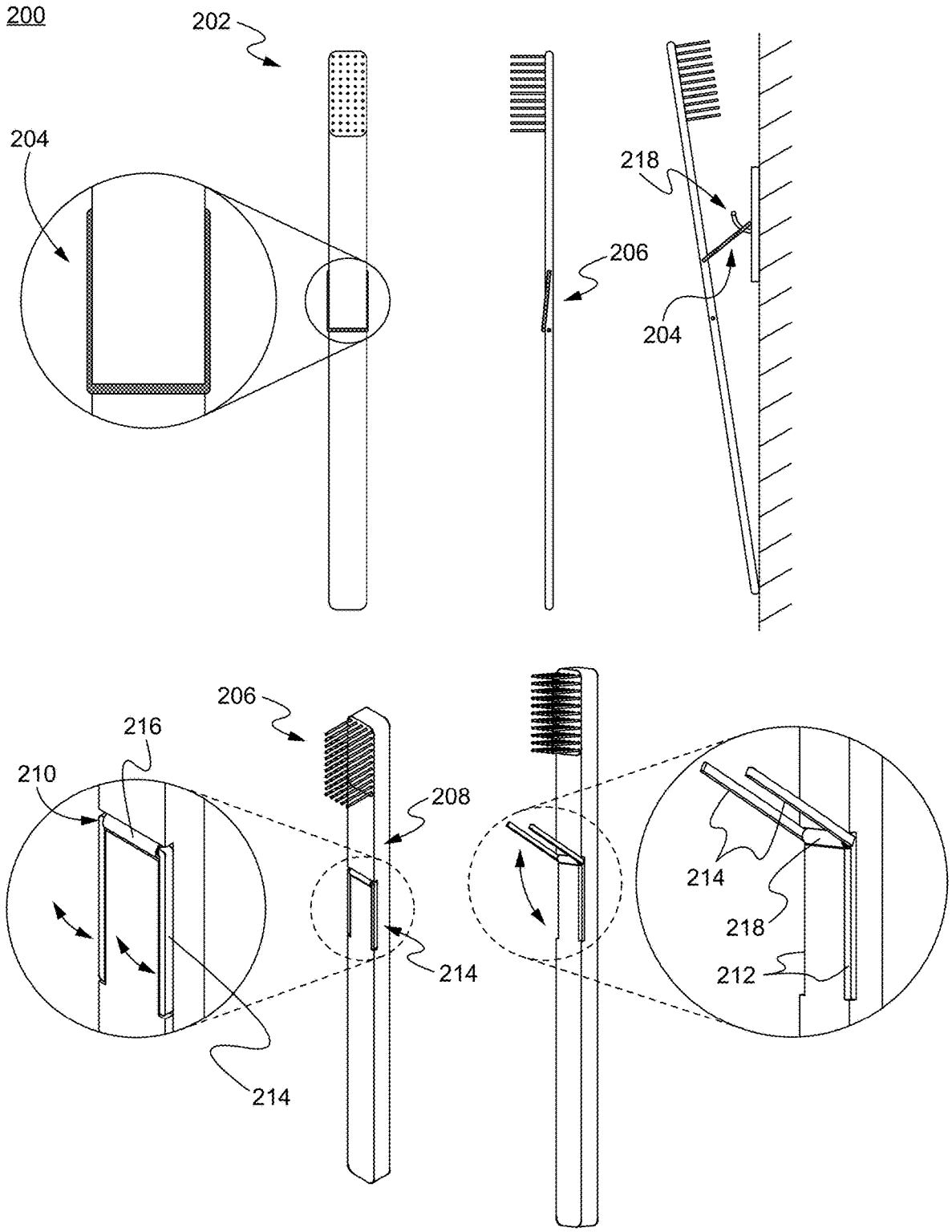
FIG. 2 illustrates a ring shape structure of the self-supporting toothbrush in accordance with some embodiments.

FIG. 2 illustrates a ring shape structure 200 of the self-supporting toothbrush in accordance with some embodiments. In some embodiments, the supporting structure (e.g., the supporting structure 106 in FIG. 1) of the toothbrush 202 comprises a C-ring structure 204. In some embodiments, the C-ring comprises an elastic plastic or elastic metal ring member, which is elastically clipped on or clamped on the side of a body of the toothbrush. In some alternative embodiments, the C-ring comprises a rigid ring structure (e.g., a metal ring), which cannot be easily deformed by human finger forces. In some embodiments, the C-ring structures 204 provides a loop structure for hanging the toothbrush on a hook 218 or any other protruding structure.

In some other embodiments, the supporting structure of the toothbrush 206 comprises a close loop structure 208. The close loop structure 208 comprises a ring structure 214 and a bar member 210. The bar member 210 is configured to going through a through hole 216 and shaped to be freely rotating therewithin. In some embodiments, the two legs 214 and the closing bar member 210 are in a fixed frame structure, wherein the bar member 210 is fixed or immobilized to the two legs 214. A transition between an opening and a close position of the supporting structure of the toothbrush 206 is made through the rotation of the bar structure 210 inside the through hole 216.

In some other embodiments, the bar structure 210 is immobilized inside the through hole 216, and the transition between an opening and a close position of the supporting structure of the toothbrush 206 is made through the two legs 214 rotating along the bar structure 210.

In some other embodiments, the body of the toothbrush 206 comprises indents 212 at the both sides of the toothbrush to accommodate the C-ring structure 214, so the C-ring structure 214 does not protrude out from the body. In other words, the supporting structure is flush with a body surface of the toothbrush.

Figure 3:
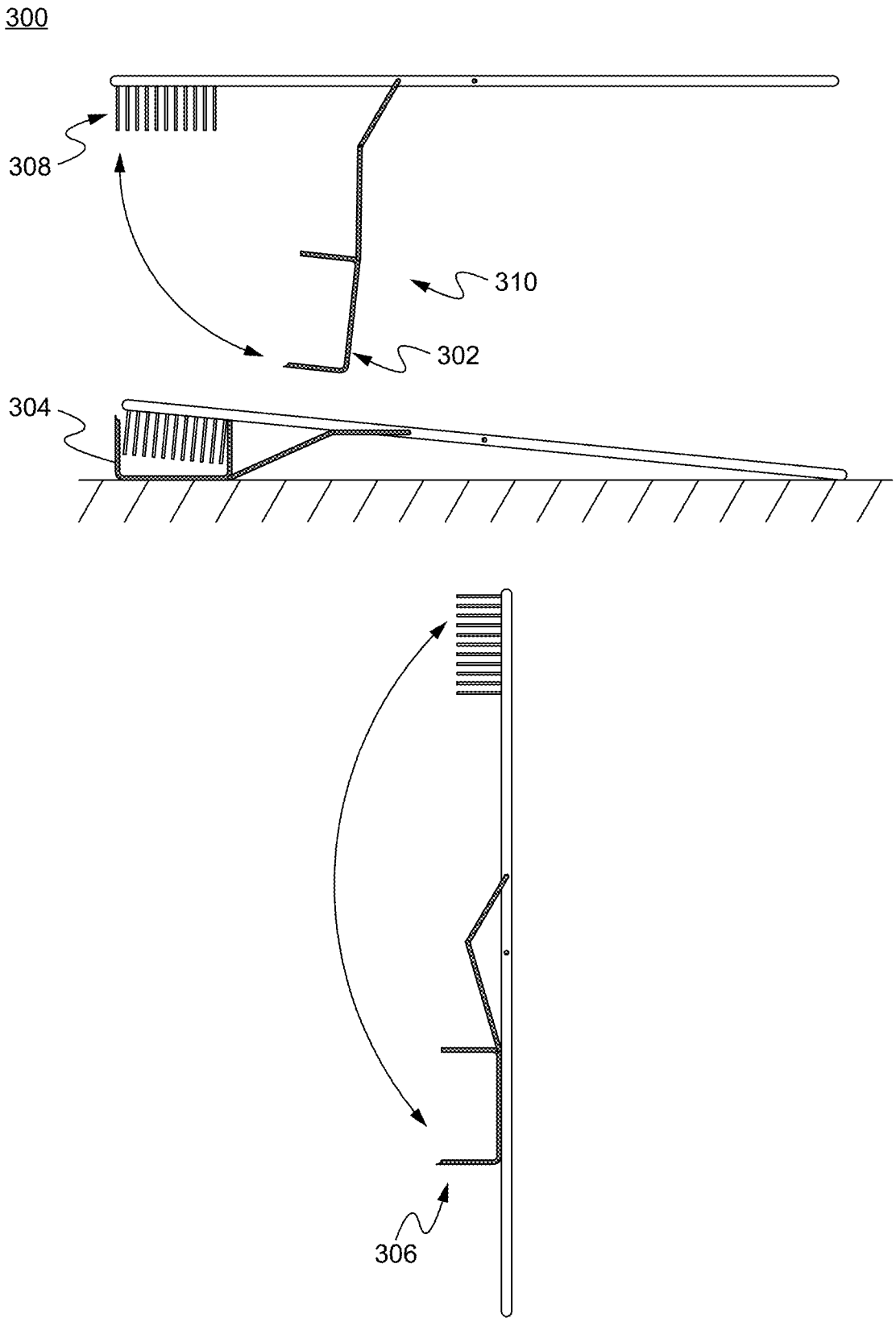
FIG. 3 illustrates a self-concealing structure of a toothbrush in accordance with some embodiments.

FIG. 3 illustrates a self-concealing structure of a toothbrush 300 in accordance with some embodiments. In some embodiments, the toothbrush 300 comprises a self-concealing structure 310. The self-concealing structure 310 comprise a cover 302. The cover 302 is structured to automatically cover the bristle 308 when the toothbrush 300 is in a resting position 304, such as when it is laced on a table surface. When the toothbrush 300 is removed from the resting position 304, the cover 302 falls out from covering the bristle 308 so that the cover is in an open position 306.

Figure 4:
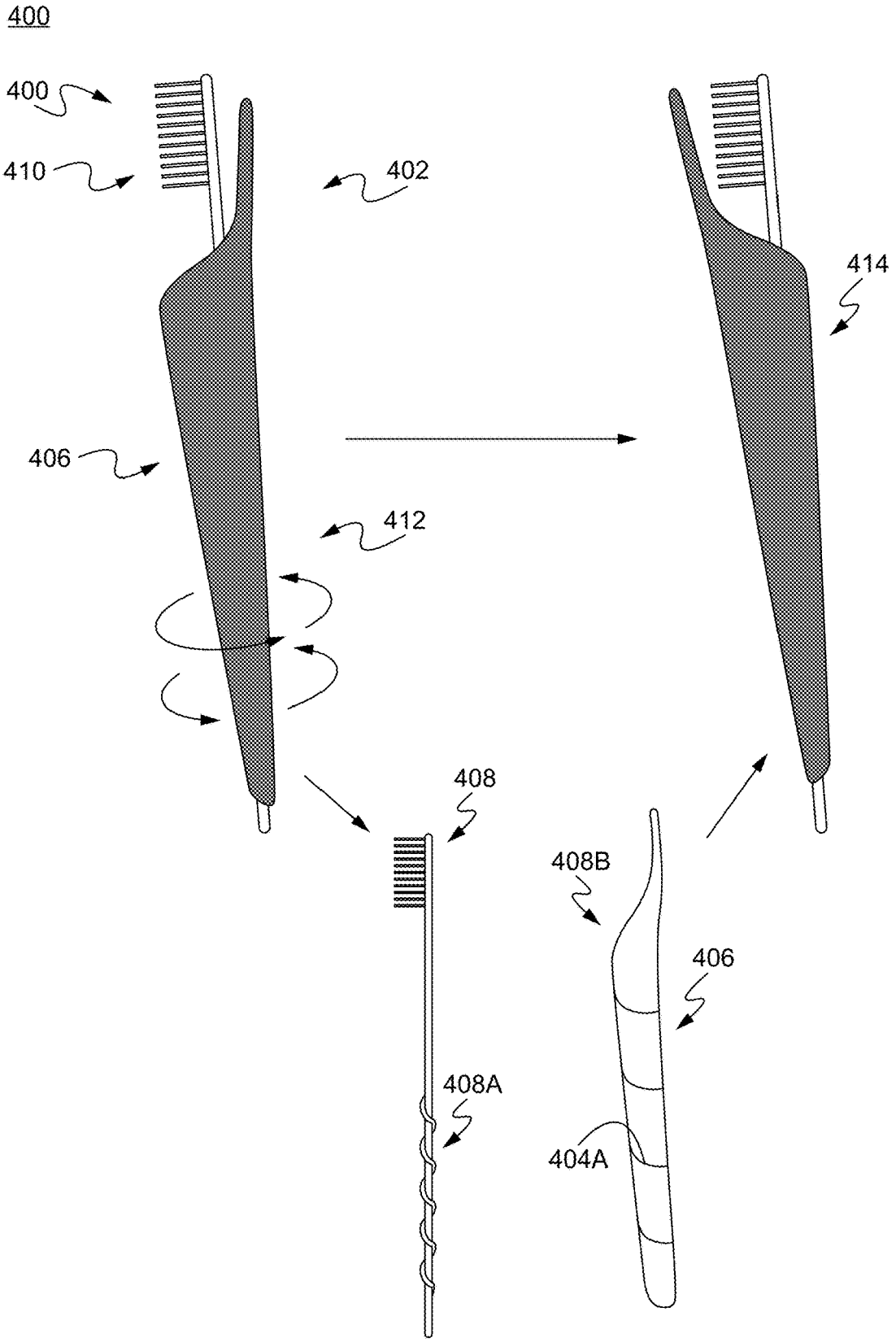
FIG. 4 illustrates another self-concealing structure of a toothbrush in accordance with some embodiments.

FIG. 4 illustrates another self-concealing structure of a toothbrush 400 in accordance with some embodiments. The toothbrush couples with a cover a sheath or a tube 406. The tube 406 has a head covering 402. The tube 406 can comprises a hollow body 404B having sliding groove 404A therewithin. The sliding grooves 404A are at the inner surface of hollow body 404B of the tube 406 forming a rotational sliding guide allowing the protruding spiral rail 408A on the toothbrush to rotationally move along the sliding guide, so that the tube 406 is able to sliding up and down along a body of the toothbrush 400. When the tube 406 slides down, the head 410 of the toothbrush is exposed so that the toothbrush is in a ready-to-use position 412. When the tube 406 slides up, the head covering 402 shields the head 410 forming a protective cover as in a close or resting position 414.

Figure 5:
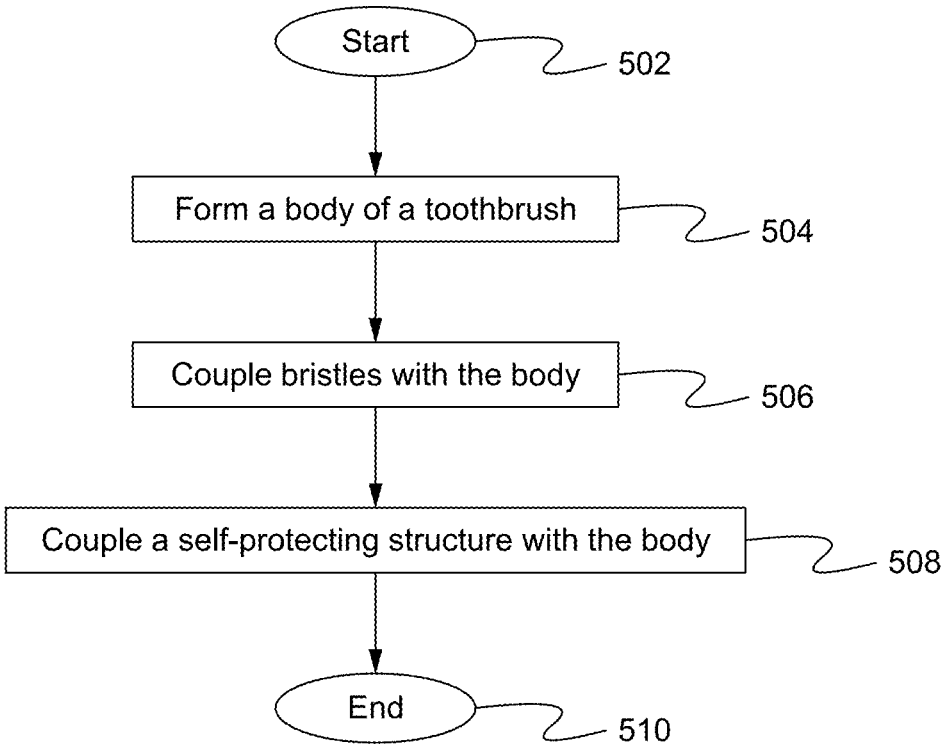
FIG. 5 illustrates a method of making self-protecting toothbrush in accordance with some embodiments.

FIG. 5 illustrates a method 500 of making self-protecting toothbrush in accordance with some embodiments. The method can begin at a Step 502. At a Step 504, a body of toothbrush is formed. The body of the toothbrush can be made of plastics (e.g., polypropylene, polyethylene, PVC, polystyrene, polyurethane, and any other polymeric materials), metals, or any other materials to form the elongated bar members. Molding or extruding to form the body of the toothbrush can be exemplary manufacturing methods of making the body. The body can comprise a handle portion for user to hold onto the toothbrush.

At a Step 506, bristles are coupled with the body. The coupling can be achieved by using ultrasonic plastic welding, which joins the bristles with the body through the use of heat generated from high-frequency mechanical motion. It is accomplished by converting high-frequency electrical energy into high-frequency mechanical motion. The mechanical motion, along with applied force, creates frictional heat at the plastic components' mating surface so the plastic material melts and forms a molecular bond between the bristles with the body. Any other method of joining the bristles with the body are within the scope of the present disclosure.

At a Step 508, a self-protecting structure is coupled with the body. The self-protecting structure can be a self-expanding stand, a self-concealing cover, or any other structure that can be deployed to protect the head and/or bristles from contamination. The method 500 can stop at a Step 510.

Figure 6:
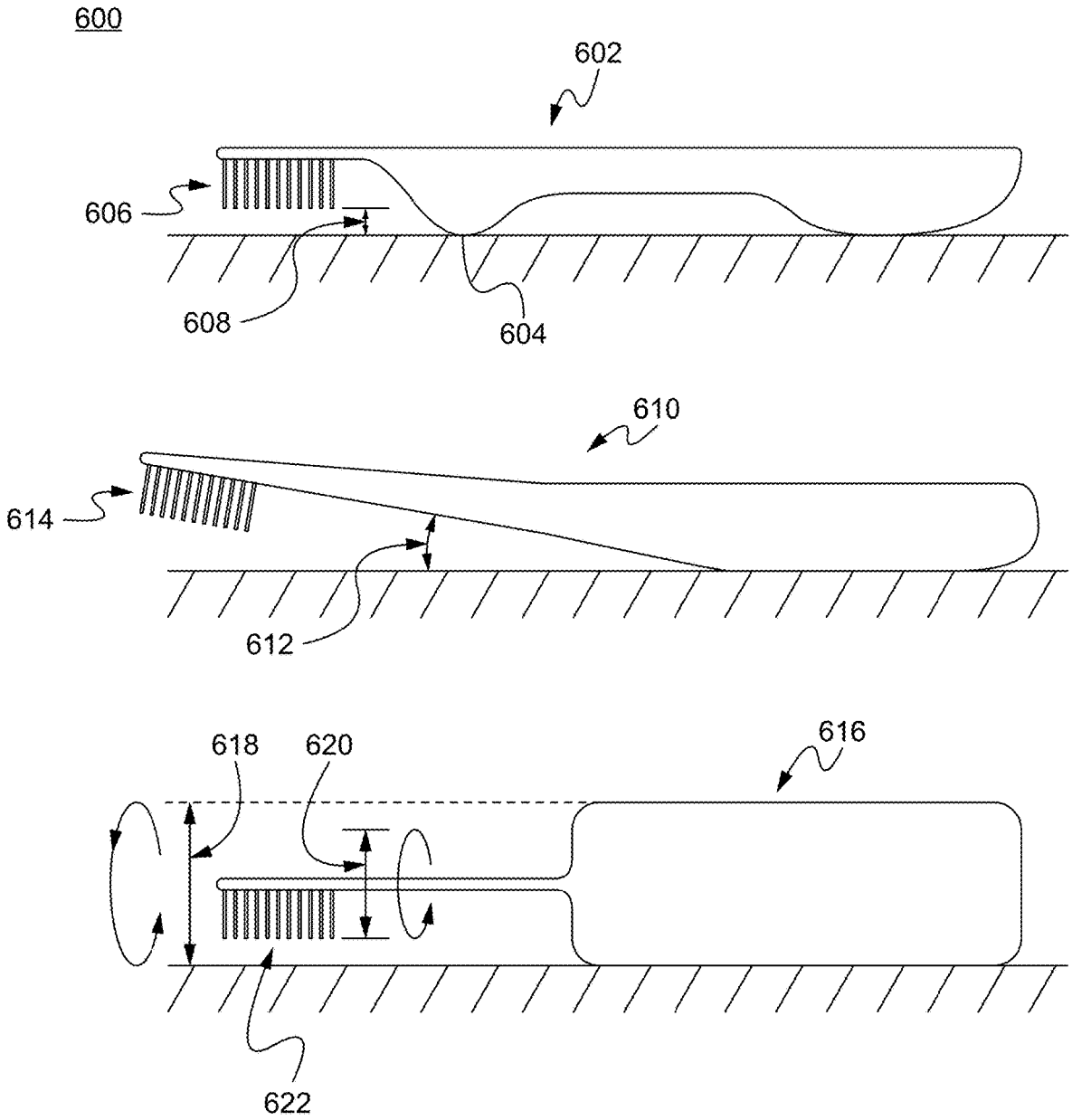
FIG. 6 illustrates a self-supporting toothbrush in accordance with some embodiments.

FIG. 6 illustrates a self-supporting toothbrush 600 in accordance with some embodiments. The toothbrush 600 comprises a structure that prevents the bristles and/or head of the toothbrush 600 from direct contacting a resting surface. For example, the toothbrush 602 comprises a supporting point 604 (e.g., a location of thumb resting structure or thumb holder), which structurally supports the head 606 so that the head 606 keeps a distance 608 from touching a resting surface. In another embodiments, the toothbrush 610 comprises a lifted head 614. The head 614 is at an angle 612 (e.g., 30-60 degrees) from a central axis of the handle of the toothbrush, so that the head 614 does not touch a resting surface. In another embodiments, the toothbrush 616 comprises a wide body having a head 622 with bristles along a rotational center. The rotational diameter 620 of the head 622 with the bristles is smaller than the rotational diameter 618, so that the head 622 with its bristles do not touch the surface when the toothbrush 616 is in a resting position.

In utilization, the toothbrush with the self-protecting structure is used to maintain a hygienic surface of the toothbrush preventing its head or bristles from a direct contact with unclean substances when the toothbrush is in a resting position.

In operation, the self-protecting toothbrush automatically deploying its protecting mechanisms or structure when the toothbrush is place on a surface for a resting position. When a user picks up the toothbrush, which automatically closes its protecting mechanisms or structure.

The present invention has been described in terms of specific embodiments incorporating details to facilitate the understanding of principles of construction and operation of the invention. Such reference herein to specific embodiments and details thereof is not intended to limit the scope of the claims appended hereto. It is readily apparent to one skilled in the art that other various modifications can be made in the embodiment chosen for illustration without departing from the spirit and scope of the invention as defined by the claims. Features in various examples or embodiments are applicable throughout the Present Specification.

What is claimed is:

1. A self-concealing toothbrush comprising:

a) a handle on a first end of a body;

b) bristles on a second end of the body; and c) a self-concealing structure on the body, wherein the self-concealing structure comprises a continuously solid cover and is configured to automatically cover the bristles when the toothbrush is in a resting position by including an angled arm with a first segment and a second segment, the first segment configured to rest substantially flat against the handle when the self-concealing structure is covering the bristles, and wherein the back of the self-concealing structure is configured to rest flat against the handle when the toothbrush is in an open position.

2. The self-concealing toothbrush of the claim 1, wherein the cover is structured to enclose the entire bristles when the body rests against a surface.

3. The self-concealing toothbrush of the claim 1, wherein the cover is structured to automatically decouple from the bristles when the self-concealing toothbrush is lifted up from a resting surface.

4. A method of making a self-protecting toothbrush comprising:

a) forming a toothbrush body having a protruding spiral rail, wherein the protruding spiral rail is part of a grip, wherein only approximately half of the body includes the protruding spiral rail, further wherein a bottom portion of the toothbrush body is smooth without the protruding spiral rail;

b) coupling bristles on the toothbrush body; and c) coupling a self-protecting structure with the toothbrush body, wherein the self-protecting structure comprises a self-concealing case spirally rotatable to conceal the bristles, further wherein the self-concealing case includes a rotational sliding guide configured for receiving the protruding spiral rail, wherein the self-concealing case includes a bristle guard, further wherein the self-concealing case includes an opening in a bottom of the self-concealing case for receiving the bottom portion of the toothbrush body such that the bottom portion of the toothbrush body protrudes out of the opening of the bottom of the self-concealing case, wherein the self-concealing case is configured to automatically cover ends of the bristles while leaving sides of the bristles exposed when the toothbrush body is in a resting position, wherein the self-concealing case is conical with a top opening of the self-concealing case larger than the bottom opening of the self-concealing case.

5. The method of claim 4, further comprising making the self-concealing case automatically decoupled with the bristles when the self-protecting toothbrush is in a utilizing position.

6. A method of making a self-concealing toothbrush comprising:

a) forming a handle on a first end of a body;

b) coupling bristles on a second end of the body; and c) coupling a self-concealing structure on the body, wherein the self-concealing structure comprises a continuously solid cover and is configured to automatically cover the bristles when the toothbrush is in a resting position by including an angled arm with a first segment and a second segment, the first segment configured to rest substantially flat against the handle when the self-concealing structure is covering the bristles, and wherein the back of the self-concealing structure is configured to rest flat against the handle when the toothbrush is in an open position.

* * * * *